US005127172A

United States Patent [19]

Lund et al.

[11] Patent Number: 5,127,172

[45] Date of Patent: Jul. 7, 1992

[54] GUARD RAIL CLEANOUT DEVICE

[76] Inventors: Kenneth Lund, 21429 Lofton Ave. N.; Thomas W. Boesel, 16360-209th St., N., both of Scandia, Minn. 55073

[21] Appl. No.: 766,980

[22] Filed: Sep. 27, 1991

Related U.S. Application Data

[63] Continuation of Ser. No. 575,373, Aug. 28, 1991, abandoned.

[51] Int. Cl.[5] ..... E02F 3/76

[52] U.S. Cl. ..... 37/117.5; 37/141 R; 37/DIG. 12

[58] Field of Search ..... 37/117.5, 118 R, 141 R, 37/103, DIG.3, DIG.12; 172/445.1, 817

[56] References Cited

U.S. PATENT DOCUMENTS

| | | | |
|---|---|---|---|
| 1,735,297 | 11/1929 | Pardue . | |
| 2,186,081 | 1/1940 | Slavin . | |
| 2,403,820 | 7/1946 | Miller . | |
| 3,108,517 | 10/1963 | Fingland . | |
| 4,329,081 | 5/1982 | Buri . | |
| 4,395,156 | 7/1983 | Sprague . | |
| 4,609,303 | 9/1986 | Shumaker . | |
| 4,779,363 | 10/1988 | Boutrais et al. | 37/118 R X |
| 4,843,743 | 7/1989 | Durieux | 37/103 |
| 4,945,662 | 8/1990 | Kreye | 37/117.5 X |
| 4,946,392 | 6/1990 | Kitchin | 37/117.5 X |

OTHER PUBLICATIONS

"Men See Money in Sand, Clean Up, " Chris J. Bohrer, Washington County (Minn.) *Washline*, p. 2, Jun.-Jul. 1990.

"Innovative employees Win Awards," Kay Bruchu, Washington County (Minn.) *Washline*, p. 1, May-Jun. 1991.

*Primary Examiner*—Randolph A. Reese
*Assistant Examiner*—J. Russell McBee
*Attorney, Agent, or Firm*—Jacobson & Johnson

[57] ABSTRACT

A device including a set of blades for removing dirt from underneath guard rails, with blades extending outward from the guard rail clean-out device in a cantilevered fashion to allow a user to extend the blades underneath and beyond the guard rails to remove dirt and gravel located under the guard rail while operating the device from the roadway.

10 Claims, 3 Drawing Sheets

GUARD RAIL CLEANOUT DEVICE

This application is a continuation of application Ser. No. 07/575,373, filed Aug. 28, 1991, now abandoned.

FIELD OF THE INVENTION

The current invention is in the area of road side maintenance equipment, more specifically, road side maintenance equipment for clearing out excessive dirt and gravel from underneath guard rails.

BACKGROUND OF THE INVENTION

Several machines, devices and methods in the prior art including U.S. Pat. Nos. 1,735,297, 2,186,081, 2,403,820, 3,108,517, 4,329,081, 4,395,156, and 4,609,303 all deal with the problem of laying new road surfaces or grading over old ones. To make roads safer, over the years people and government have installed such safety devices as road signs, traffic lights, railroad crossing arms and guard rails to prevent peoples vehicles from leaving the road. Although the guard rails are most often put on the more travelled asphalt roads, the edges of roads where the guard rails are put in often are constructed of dirt and gravel. Over the years, dirt and gravel builds up and causes problems. First of all, roads are usually designed so there is a high spot in the middle and low spots on the edge to help drain water and melting snow from the middle of the road to the edges. Dirt and gravel accumulating underneath the guard rail interferes with the natural drainage process of the road; Excessive water on the road can make the roads slippery and dangerous, and also cause long term water erosion damage. Another dangerous effect of the accumulated gravel is that it causes the effective height of the guard rails to become less, as the gravel under the guard rail can actually form a ramp. Still another adverse effect of the accumulated gravel, although not a safety hazard, is that the gravel and run-off water combine to form a perfect element for growing unsightly weeds.

Previous art has done very little to solve the problem of accumulating gravel under guard rails. In the past, road construction workers used shovels and rakes to remove and smooth the dirt and gravel, making the task very long and cost inefficient. The object of the current invention when attached to a skid steer loader is to allow a user to quickly remove dirt, gravel and weeds from underneath guard rails. By removing the excessive dirt and gravel from underneath the guard rail, water is free to drain from the road and the gravel ramp caused by excessive dirt and gravel is destroyed, thereby raising the effective height of the guard rails, resulting in safer roads and highways. The current invention also uproots the weeds that have already grown, allowing for a more pleasant driving experience.

The current invention is of a size that is compact enough to fit under almost all guard rails, yet large enough to remove excessive gravel without making several drags under the guard rail. If two guard rail posts do happen to be so close as to make head-on removal of accumulated gravel and dirt impossible, the skid steer loader can be driven at an angle so the current invention will go underneath the guard rail at an angle and still be able to remove excessive dirt and gravel.

The final object of the current invention is to provide a fast and cost efficient way to remove excessive dirt and gravel from underneath guard rails.

DESCRIPTION OF THE PRIOR ART

U.S. Pat. No. 1,735,297 is a gravel spreader designed to be pulled behind a tractor unit, smoothing out the center of the road;

U.S. Pat. No. 2,186,081 is an aggregate spreader designed to be pulled behind a dump truck allowing aggregate to be spread in a uniform volume on the road surface;

U.S. Pat. No. 2,403,820 is a spreader box designed to spread concrete and asphaltic materials in a uniform manner on a roadbed;

U.S. Pat. No. 3,108,517 is a structure that is designed to receive asphaltic materials and spread them along a roadbed;

U.S. Pat. No. 4,329,081 is a device that is towed that lays asphalt, gravel and oil mat on a road surface;

U.S. Pat. No. 4,395,156 is a sled like material spreader that is designed to be towed after a truck spreading asphaltic materials as it goes;

U.S. Pat. No. 4,609,303 is a device for slip forming concrete pathways of a predetermined width, including driveways and sidewalks.

SUMMARY OF THE INVENTION

The present invention relates to a new and useful device for removing piled up dirt and gravel underneath guard rails by using a box-like device with blades on the front to drag or push excessive dirt and gravel from underneath guard rails. Removing excessive dirt and gravel from underneath guard rails results in proper drainage and safer roadways.

DESCRIPTION OF THE PREFERRED EMBODIMENT

Figure 1:
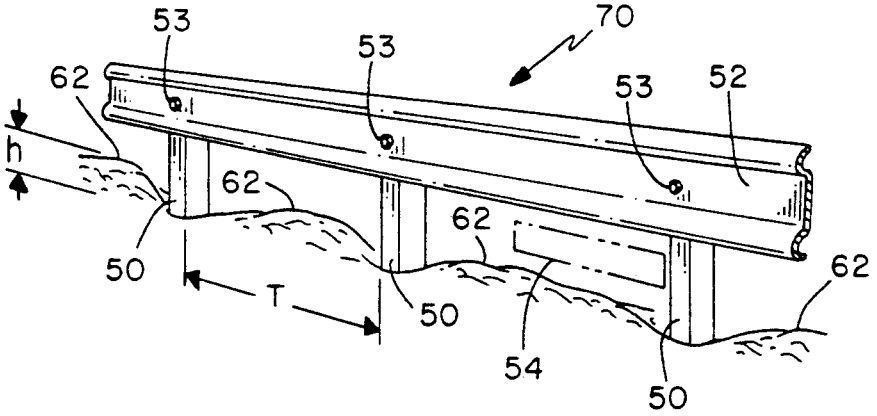
FIG. 1 is a perspective view of a series of guide posts and a guard rail connecting them.

FIG. 1 is an illustration of a guard rail 70. Reference numeral 50 points to guard posts which support a guard railing face 52. Guard railing face 52 is attached to a guard arm 51 (Not Shown) by guard bolts 53. Distance T represents the distance between guard rail posts 50, while distance h represents the height of accumulated dirt and gravel 62 underneath guard rail 70. Phantom outline 54 represents the area the front of a guard rail clean-out device 20 occupies when inserted underneath guard rail 70.

Figure 2:
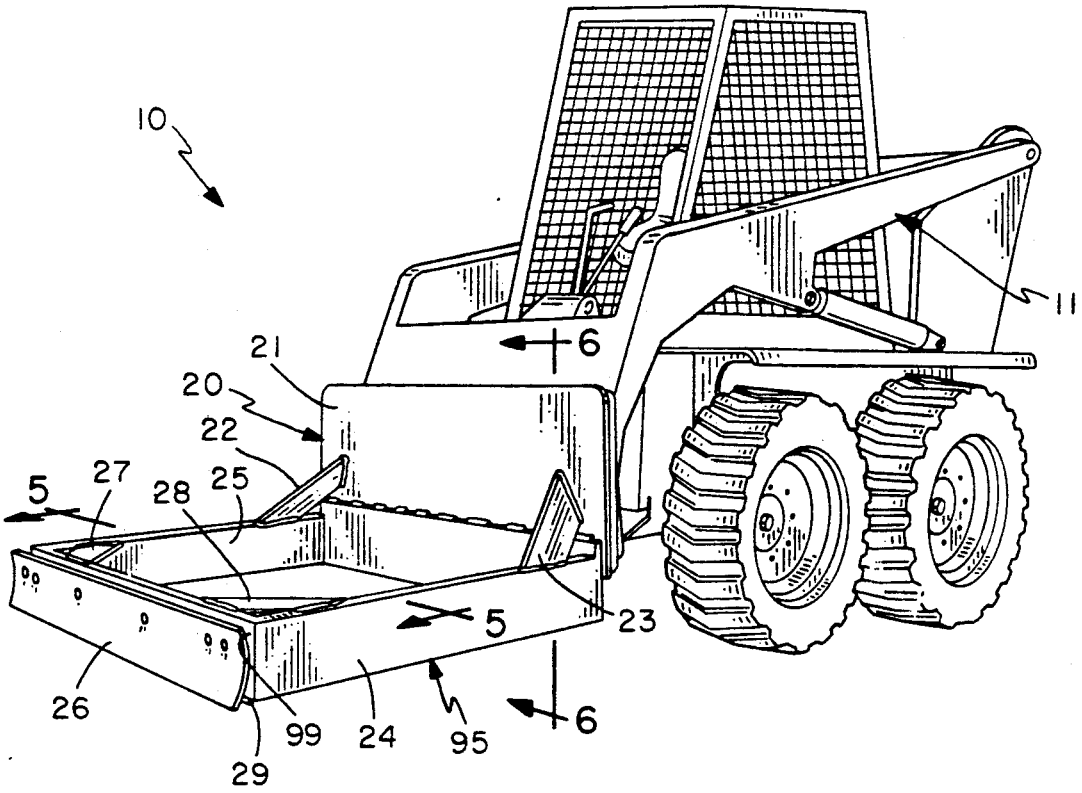
FIG. 2 is a pictorial view of the guard rail clean-out device and a skid steer loader.

FIG. 2 is as pictorial view of a skid steer loader and guard rail clean-out device combination 10. Numeral 11 refers to the action arm on the skid steer loader which attaches to guard rail clean-out device 20 and provides the power for a user to move guard rail clean-out device 20 up and down. More specifically, action arm 11 attaches to an elevated rear plate 21. Elevated rear plate 21 attaches to left side member 24 and right side member 25, which further attach to front member 99 making a box-like frame 95. Right angled member 22 and left angled member 23 provide support between the elevated rear plate 21 and the left side member 24 and right side member 25. More specifically, angled member 22 connects to right side member 25, and angled member 23 attaches to left side member 24. Left side member 24 and right side member 25 trap the dirt gravel 62 underneath the guard rail 70 and allow it to be removed without spillage. Front member 99 has a convexly shaped front blade 26 located on the outside of frame 95, and a convexly shaped rear blade 29 which are used to pull and push dirt and gravel from underneath guard railing face 52. For frontal support, front member 99 has a left frontal support strip 28 and a right frontal support strip 27 which attach to front member 99 in an angular fashion, providing rigidity and strength to frame 95.

Figure 3:
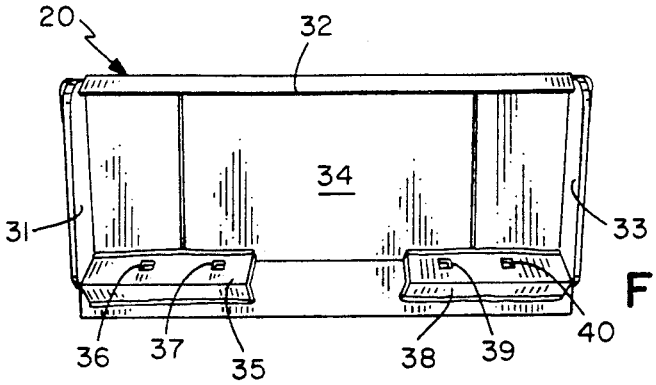
FIG. 3 is a pictorial view of the guard rail clean-out device from the back showing the means to attach the guard rail clean-out device to a skid steer loader.

FIG. 3 illustrates the back side of the guard rail clean-out device 20 with attachment for mounting guard rail clean-out device 20 on a skid steer loader. Upper lip 32, left bracket 35 and right bracket 38 are the members used to hook guard rail clean-out device 20 to a skid steer loader. Back panel 34 holds members 32, 35, and 38 together as well as attach members 32, 35, and 38 to elevated rear plate 21. The outer set of holes, outer left hole 36 and outer right hole 40 are used to attach the lower portion of guard rail clean-out device 20 to one type of skid steer loader, and the inner set of holes, inner left hole 37 and inner right hole 39 are used to attach guard rail clean-out device 20 to a different type of skid steer loader. Left standing side member 31 and right standing side member 33 are used together to provide lateral support for guard rail clean-out device 20.

Figure 4:
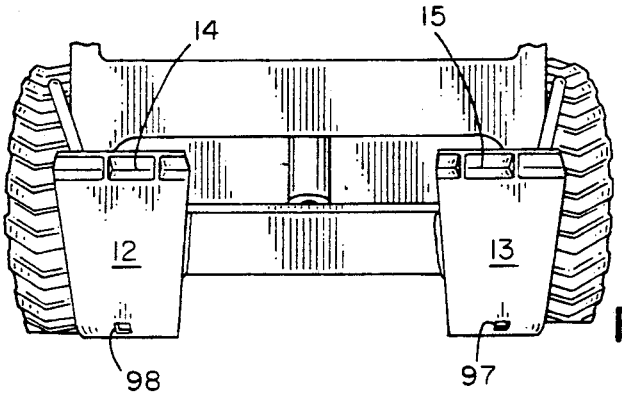
FIG. 4 is a frontal view of the means for attachment to a skid steer loader.

FIG. 4 shows the front end of one type of skid steer loader comprising a left skid lip 15, a right skid lip 14, a left skid support 13, a right skid support 12, a left skid hole 97 and a right skid hole 98. Upper lip 32 from FIG. 3 fits on left skid lip 15 and right skid lip 14. Left skid support 13 and right skid support 12 rest along back panel 34 to provide guard rail clean-out device 20 support. Left skid hole 97 and right skid hole 98 are used with the skid steer loader latch mechanisms to attach the lower portion of guard rail clean-out device 20 to the skid steer loader. The position of left skid hole 97 and right skid hole 98 will vary latitudually according to the type of skid steer loader.

Figure 5:
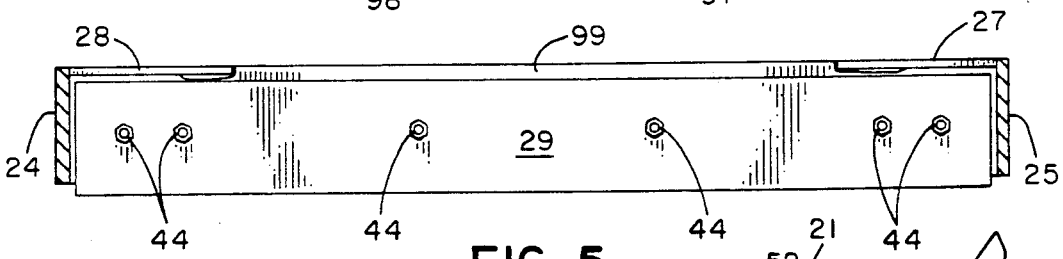
FIG. 5 is sectional view of the guard rail clean-out device taken along lines 5—5 of FIG. 2.

FIG. 5 is an inside front view of guard rail clean-out device 20. Reference numeral 29 points to the convexly shaped rear facing blade. Notice how it extends lower than the frame 95 to permit blade 29 to bite into the dirt and gravel under a guard rail. Reference numerals 44 all lead to blade bolts which are used to secure rear blade 29 and a front facing blade 26 to front member 99. Notice that front blade 26 and rear blade 29 have sharpened edges on the top and bottom to bite into the dirt and gravel. Both blades are made of a hard material to reduce wear. The positioning of blade bolts 44 allows both front blade 26 and rear blade 29 to be turned 180 degrees to use the opposite edge of front blade 26 and rear blade 29. When one side of the rear blade 29 or front blade 26 wears out, the other side can be used.

Figure 6:
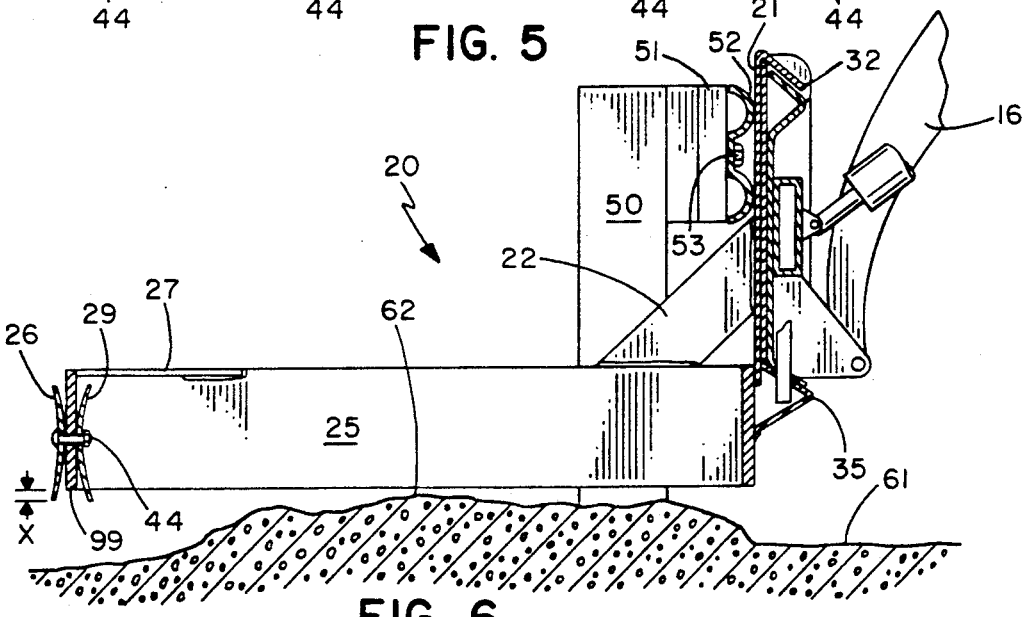
FIG. 6 is a side view taken along lines 6—6 of FIG. 2 of a guard rail clean-out device being moved underneath a guard rail.

FIG. 6 depicts guard rail clean-out device 20 being moved into position for removal of excessive dirt and gravel. Upper lip 32 is securely in place on the front of the skid steer loader. Pushing and pulling power is provided by lower action arm 16. Notice how elevated rear plate 21 acts as stop to prevent the skid steer loader from engaging guard railing face 52. Front blade 26 and rear blade 29 are spaced approximately 3 feet from elevated rear plate 21, making it possible for skid steer loader to remain on the road while removing dirt and gravel 62 from beyond and underneath guard rail 70. Notice as well, right angled member 22 clears guard arm 51 and guard railing face 52. Guard railing face 52 is attached to guard arm 51 by a guard bolt 53. Elevated rear plate 21 is of sufficient height to prevent elevated rear plate 21 from getting caught underneath guard arm 51. In addition, front plate 21 has smooth surface so that lowering guard rail clean-out device 20 does not catch on and damage guard rail facing 52. Numeral 50 points to the guard rail post, which holds guard arm 51 and guard railing face 52 off of a ground surface 61. Right side member 25 extends underneath guard arm 51. Blade bolt 44 attaches front blade 26 and rear blade 29 securely onto front member 99. Height x is the distance blades 26 and 29 extend below inside member 99 and side members 24 and 25. Typically x is from one to two inches long which is sufficiently long enough to permit blade 26 or 29 to bite into the dirt and gravel located beneath a guard rail.

Figure 7:
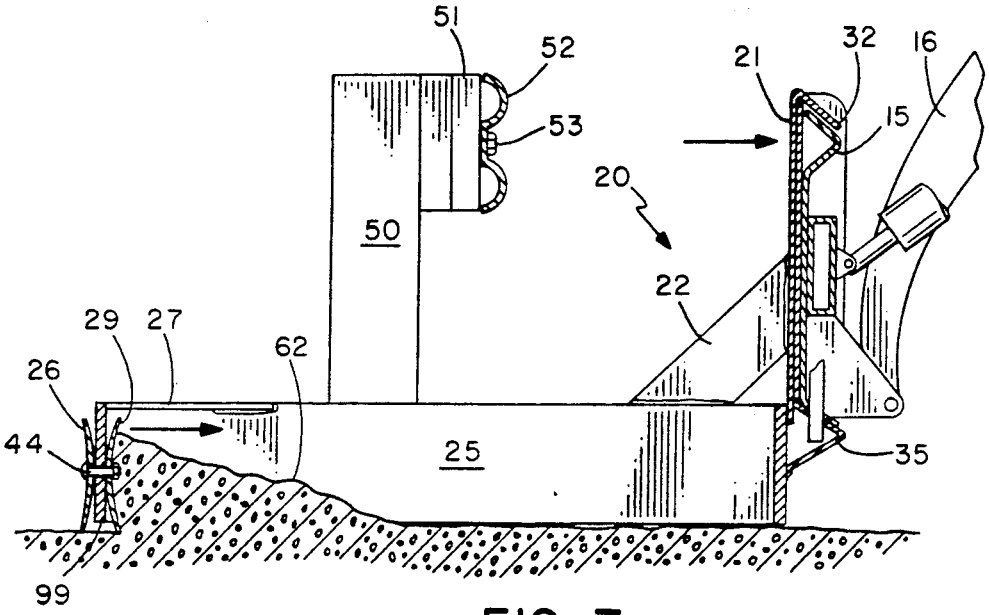
FIG. 7 is a side view of a guard rail clean-out device being used to remove excessive gravel under the guard rail.

FIG. 7 illustrates the process of removing dirt and gravel 62 after guard rail clean-out device 20 has been lowered by lower action arm 16. By pulling guard rail clean-out device from under the guard railing face 52 one removes dirt and gravel 62 from underneath guard arm 51, guard railing face 52, and guard bolt 53. Guard rail post 50 does not interfere with the removal process. Since blades 26 and 29 are slightly shorter than the width of frame 95 and are mounted on member 99 so that the ends of the grader blades do not protrude laterally past side members 24 and 25. Consequently, the smooth exterior surfaces on members 24 and 25 slide along but do not catch on the guide post 50 as one withdraws guard rail clean-out device from underneath a guard rail.

Figure 8:
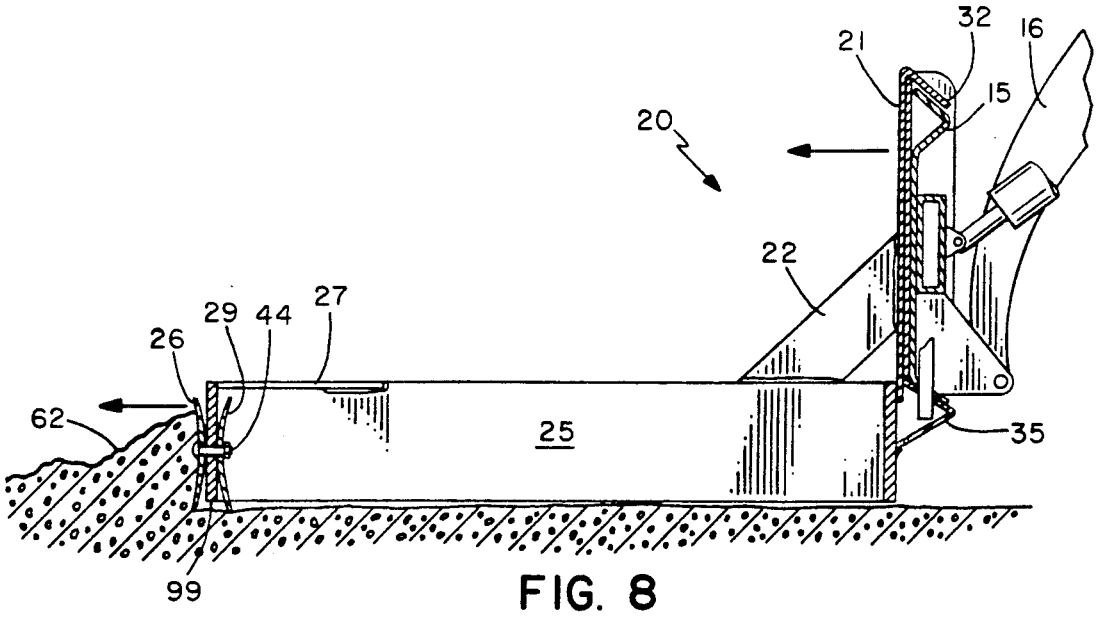
FIG. 8 is a side view of the guard rail clean-out device being used to push gravel.

In some instances a user may want to push the dirt and gravel into a ditch behind the guard rail. FIG. 8 is an illustration of guard rail clean-out device 20 being pushed forward by lower action arm 16 to push the dirt and gravel off to the side. However, using front blade 26 a user can also push dirt and gravel into a ditch behind the guard rail if the dirt and gravel would not block off the ditch.

In operation of the invention, guard rail clean-out device 20 is attached to a skid steer loader. A driver (Not Shown) of the skid steer loader drives the skid steer loader up to the guard railing face 52, thereby extending the guard rail clean-out device underneath the guard rail (FIG. 6). The driver then lowers the guard rail clean-out device around a pile of dirt and gravel 62 that is under the guard rail 70 using the skid steer loader. When the driver drives the skid steer loader backwards, blade 29 and frame 95 of the guard rail clean-out device coact to form a U-shaped enclosure to pull the dirt and gravel backwards thus removing the dirt and gravel from underneath the guard rail (FIG. 7). This invention is designed with sufficient width (typically about 4 feet) so that a user needs to make only two passes underneath a guard rail to clean out the dirt and gravel between adjacent guard rail posts. That is, in the preferred embodiment the guard rail clean-out device has sufficient width to extend slightly over halfway across the opening between guard rail posts so the operator can clean the dirt and gravel between adjacent guard rail posts with only two passes of guard rail clean out device. While not all guard rail posts are the same distance apart, the guard rail clean-out device has been designed to clean under most guard rails by having a width greater than the halfway distance between adjacent guard rail posts.

What is claimed is:

1. A guard rail clean-out device for moving dirt and gravel from underneath a guard rail comprising:

a frame box type structure that is extendible under a guard rail, said frame box type structure having a front member with an inside and an outside, a rear elevated backing plate, and two side members, said two side members each having a first end connected to said front member and a second end connected to said rear elevated backing plate, said two side members spaced sufficiently close so as to permit insertion of at least a portion of said frame box type structure between adjacent guard rail posts supporting a common guard rail, said rear elevated backing plate having a rear portion to allow the device to be attached to a skid steer loader, said rear elevated backing plate forming a stop to limit a portion of the frame box type structure that is extendible under a guard rail;

a first blade for moving dirt or gravel, said first blade located on the inside of the front member of said frame box type structure with said first blade facing towards said rear elevated backing plate, said first blade spaced sufficiently far from said rear elevated backing plate so as to create a region between said first blade and said rear elevated backing plate for placing on both sides of gravel located beneath said guard rail, said first blade extending below said frame box type structure so that a user can insert said front member between adjacent guard rail posts and over and around dirt or gravel located beneath the guard rail whereby said front member can be lowered around the dirt and gravel to permit a user to remove the dirt and gravel by withdrawing said first blade from beneath the guard rail.

2. A device as in claim 1 wherein a second blade, located on the outside of said frame with said second blade facing in an opposite direction from said first blade.

3. A device as in claim 1 wherein said elevated backing plate has an upper lip to latch on to a skid steer loader and two lower members which enable said frame to be attached to the skid steer loader.

4. A device as in claim 1 wherein two angled members connect said elevated backing plate and said side members together to provide braces for said side members.

5. The device of claim 1 wherein said side members have smooth surfaces to permit either of said side members to slide along a guard rail post without catching on the guard rail post.

6. The device of claim 5 wherein said first blade extends outward from said rear elevated backing plates in a cantilevered manner.

7. A method for removing dirt and gravel from underneath a guard rail and between spaced adjacent guard rail posts located at the sides of a roadway including the following:

positioning a guard rail clean-out device having a box-like frame formed by a front member and a back panel connected to each other by a pair of side members with the box-like frame having a blade until the blade is located substantially perpendicular to a guard rail and between adjacent spaced guard rail posts;

lowering the blade until the blade is in a position to move gravel and dirt located beneath the guard rail along a ground surface and in a direction generally perpendicular to the guard rail; and moving the blade beneath the guard rail and between adjacently spaced guard rail posts by extending a portion of the frame of the guard rail clean-out device under the guard rail to permit the blade to engage the dirt and gravel located beneath the guard rail to thereby allow a user to remove the dirt and gravel located beneath the guard rail by moving the blade substantially perpendicular to the guard rail.

8. The method of claim 7 including the step of moving the blade in a backwards or forwards motion to spread out the dirt and gravel located beneath the guard rail.

9. The method of claim 7 wherein the guard rail clean-out device is located on the roadway and a user moves the blade and frame towards the roadway to remove the dirt and gravel-located beneath the guard rail.

10. A guard rail clean-out device for removing accumulated dirt and gravel from between guard rail posts and underneath a guard rail facing comprising:

a frame, said frame including a back panel, a first side member having a first end and a second end with said first end of said first side member connected to said back panel, a second side member having a first end and a second end with said first end of said second side member connected to said back panel, and a front member cantileverly supported by said first side member and said second side member, said front member having a portion extendible underneath a guard rail;

a blade located on said front member, said blade being sufficiently small so as to fit under said guard rail and between adjacently spaced guard rail post supporting said guard rail; and means for moving said blade toward, under, and away from said guard rail to thereby allow a user to remove dirt and gravel located beneath the guard rail by moving said blade from a first side of said guard rail to a second side of said guard rail by moving said blade underneath said guard rail.

* * * * *